United States Patent [19]

Kawai et al.

[11] Patent Number: 4,709,555

[45] Date of Patent: Dec. 1, 1987

[54] VARIABLE DELIVERY REFRIGERANT COMPRESSOR OF DOUBLE-ACTING SWASH PLATE TYPE

[75] Inventors: Katsunori Kawai; Hisao Kobayashi; Hiroyuki Deguchi; Shuichi Sugizono, all of Kariya, Japan

[73] Assignee: Kabushiki Kaisha Toyoda Jidoshokki Seisakusho, Kariya, Japan

[21] Appl. No.: 879,345

[22] Filed: Jun. 27, 1986

[30] Foreign Application Priority Data

Jul. 2, 1985 [JP] Japan ..... 60-145399

[51] Int. Cl.[4] ..... F25B 1/00; F25B 41/00

[52] U.S. Cl. ..... 62/228.3; 62/196.2; 62/217

[58] Field of Search ..... 62/217, 228.5, 228.3, 62/228.1, 196.3, 196.2, 196.1, 208, 209; 417/296, 297, 269, 270, 299

[56] References Cited

U.S. PATENT DOCUMENTS 2,319,130 5/1943 Hanson ..... 62/196.2 X 2,766,593 10/1956 Mitchell et al. ..... 62/217

4,519,750 5/1985 Kurahashi et al. ..... 417/296 X

*Primary Examiner*—Harry Tanner

*Attorney, Agent, or Firm*—Brooks Haidt Haffner & Delahunty

[57] ABSTRACT

The present invention contemplates a delivery control valve arrangement adapted for use in a refrigerant gas compressor of double-acting swash plate type in which its delivery capacity can be varied automatically by placing the compression chambers on one side of the compressor under "loaded" and "unloaded" conditions alternately in response to the cooling load. The valve arrangement includes valve means for establishing fluid communication passages for selective application of discharge and suction pressures of the compressor to a plunger movable between two positions corresponding to the loaded and unloaded conditions, respectively, and actuator means operable in response to evaporator-suction or suction-atmosphere pressure differential for actuating the above valves.

6 Claims, 10 Drawing Figures

VARIABLE DELIVERY REFRIGERANT COMPRESSOR OF DOUBLE-ACTING SWASH PLATE TYPE

FIELD OF THE INVENTION

The present invention relates generally to a variable delivery refrigerant compressor of the double-acting swash plate type. More specifically, it relates to a refrigerant compressor of the above type wherein the compressor's delivery capacity can be changed automatically in response to varying pressure differential which in turn depends on the cooling load.

BACKGROUND OF THE INVENTION

Refrigerant compressors of the double-acting swash plate type having compression chambers on both sides of each double-acting piston are known which can vary delivery capacity by use of a control device which is designed to render the compression chambers on side under "loaded" and "unloaded" (or idle) conditions alternately in response to the varying cooling capacity demand, thus making possible the change of the compressor's delivery capacity without depending on a clutching operation. For this purpose, two methods have been proposed heretofor. According to one method disclosed by Publication of Japanese Patent Application No. 59-200084 (1984), discharge-suction pressure differential is utilized for controlling of the load-unload changing, which method may be referred to as internal control system. The other method disclosed by U.S. Pat. No. 4,403,921 makes use of electrical control signals provided by any external device adapted for detecting the varying cooling load, which method may be referred to as external control system.

For the sake of better understanding of the background on which the present invention is based, reference is made to FIGS. 9 and 10 of the attached drawings which show compressors operable according to these internal and external control systems, respectively.

In the compressor having an internal control system shown in FIG. 9, a movable, pressure responsive plunger 24 having a discharge valve 14R and retainer 26 screwed to its front side and a variable volume chamber 25 formed on the opposite back side thereof is slidably mounted in rear housing 15R substantially in alignment with a drive shaft 2 mounted centrally in the compressor. There is provided a by-pass port 21 bored through a rear valve plate 10R for communication with a crankcase 4, in which a swash plate drive mechanism is incorporated, through a by-pass passage 22' formed in a spring holder 22 and space formed over the rear end of the drive shaft 2. A spring 28 is mounted in the spring holder 22 for urging the plunger 24 in rearward direction which causes the discharge valve 14R to move away from the discharge port 12R. On the other hand, the variable volume chamber 25 behind the plunger 24 communicates by way of a connection passage 25' with a front discharge chamber 18F. In operation, the plunger 24 is actuated to and fro in response to the pressure differential between discharge pressure applied to the back side of the plunger and suction pressure acting on the front side thereof, whereby the compression chambers on the rear side of the compressor are "unloaded" when the plunger 24 is moved to where the discharge valve 14R is kept away from the discharge port 12R and the by-pass port 21 is opened to thereby allow the refrigerant gas displaced by pistons 5 to be by-passed into the crankcase 4.

Then referring to FIG. 10 illustrating a compressor whose delivery capacity is externally controlled, the compressor per se is substantially the same as that shown in FIG. 9, except that the chamber 25 behind the plunger 24 is selectively communicable with a suction chamber (rear 17R or front 17F) and front discharge chamber 18F through controlled operation of respective solenoid valves 62 disposed between a discharge flange and a suction flange and actuated by control signals supplied from a sensor provided in the suction conduit line for detecting the varying temperature or cooling load through a control 64 (or amplifier) operable on the valves 62 in response to the control signals. Depending on the actuation of the valves 62, suction and discharge pressures are applied selectively to the rear side of the plunger 24, thereby loading and unloading the compression chambers on the rear side of the compressor in the same manner as in the internal control system.

With the compressor having the internal control system, however, the pressure differential between the discharge pressure applied to the back side of the plunger 24 and the suction pressure acting on the opposite front side is varied in response not only to the cooling load, but also to other irrelevant factors such as rapid changes in engine or compressor speed. As a result, the compressor with the internal control system has offered disadvantages in that the loading/unloading control tends to be performed erroneously and the discharge valve 14R attached to the pressure responsive plunger 24 is moved too sensitively, causing too frequent repetition between opening and closing operations and hence inaccurate operation of the discharge valve with respect to the varying cooling load. In addition, such frequent repetition of the discharge valve operation affects its durability and causes poor sealing between the discharge valve 14R and the valve plate 10R, allowing high-pressure, high-temperature discharge gas to enter the low-pressure suction chamber, with the result that the bearings, shaft seals, etc. are deteriorated by such discharge gas. With the external control system shown in FIG. 10, these problems may be solved, but it requires costly external parts including a temperature sensor, control for processing control signals transmitted by the sensor, and solenoid valves for controlling refrigerant gas flow. The use of such additional parts only makes the overall system more complicated and hence more costly to manufacture.

SUMMARY OF THE INVENTION

It is an object of the present invention, therefore, to provide a refrigerant gas compressor of double-acting swash plate type which can obviate the above drawbacks of the conventional compressors.

The present invention contemplates a delivery control valve arrangement adapted for use in a refrigerant gas compressor of double-acting swash plate type in which its delivery capacity can be varied automatically by placing the compression chambers on one side of the compressor under "loaded" (or 100% delivery capacity) and "unloaded" (or 50% delivery capacity) conditions alternately in response to the cooling load. The valve arrangement includes valves for establishing fluid communication passages for selective application of the discharge and suction pressures of the compressor to a plunger movable between two positions corresponding to the loaded and unloaded conditions, respectively, and actuator means operable in response to pressure differential for actuating the above valves. Throttling valve means is provided between an evaporator and the suction side of the compressor for throttling the refrigerant gas passing therethrough in such a way that the throttling effect is increased with a drop of the evaporator pressure which prevails on the upstream side of the throttling valve and is decreased with reduction of the cooling load. This evaporator pressure and suction pressures available on the downstream side of the throttling valve provide the pressure differential necessary for controlling the operation of the actuator means. Alternatively, suction-atmosphere pressure differential may be utilized for the same purpose.

In operation, when the compressor is operating under full load and hence evaporator pressure is fairly high, the actuator means is positioned by the least or substantially zero pressure differential so as to operate on the valves to make fluid communication which allows the discharge pressure to be applied to the plunger for unloading the compression chambers on one side of the compressor. As the pressure differential is increased with reduction of the cooling load, the actuator means operates on the valves in such a way to maintain the application of the discharge pressure to the plunger to thereby keep the compressor working at its 100% delivery capacity. When the cooling load is further reduced with the pressure differential increased to a predetermined control point, the valves are actuated then to allow the suction pressure to be applied to the plunger, so that the latter is moved to a position corresponding to the unloaded condition of the compression chambers, thus placing the compressor in operation under 50% delivery capacity. This change from the loaded to unloaded condition causes the pressure differential to drop, which acts on the actuator means such that the valves establish fluid communication wherein the application of the suction pressure to the plunger is maintained, thus permitting the compressor operating at its reduced or 50% delivery capacity.

The compressor according to the present invention can achieve assured delivery capacity changing from 100% to 50% and vice versa according to the varying cooling load without any influence due to discharge-suction pressure differential which tends to varied in response not only to the varying cooling load, but also to other factors such as rapid changes in compressor speed. Therefore, the above-mentioned problems encountered by the conventional compressors can be solved successfully.

The above and other objects and features of the present invention will be apparent from the following detailed description of the preferred embodiments thereof in conjunction with the accompanying drawings.

DETAILED DESCRIPTION OF THE PREFERRED EMBODIMENTS

Figure 1:
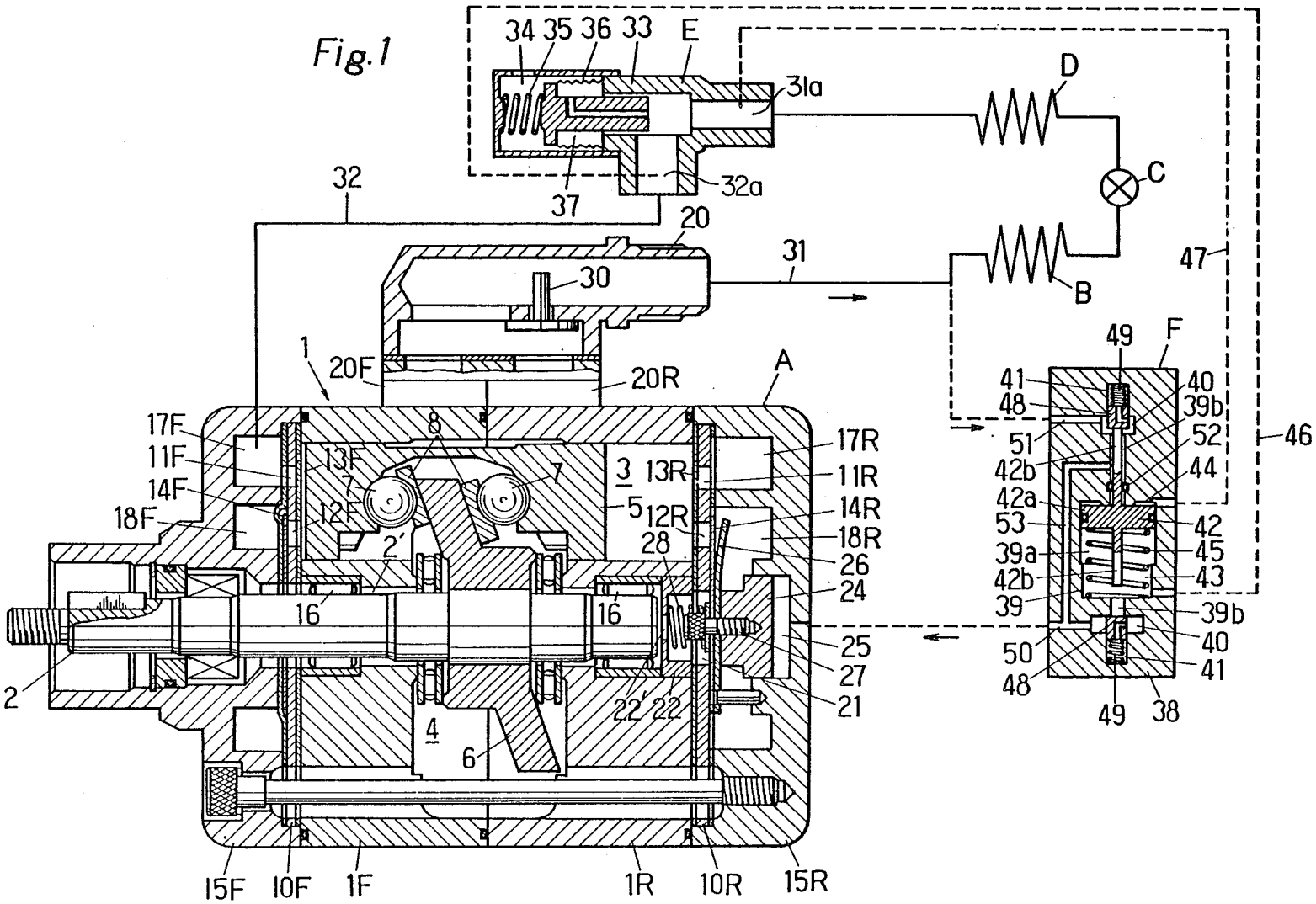
FIG. 1 is a cross-sectional view of a variable delivery refrigerant compressor of the double-acting swash plate type arranged in an air conditioning system and having connected thereto the preferred embodiment of a delivery control mechanism in accordance with the present invention.
Figure 2:
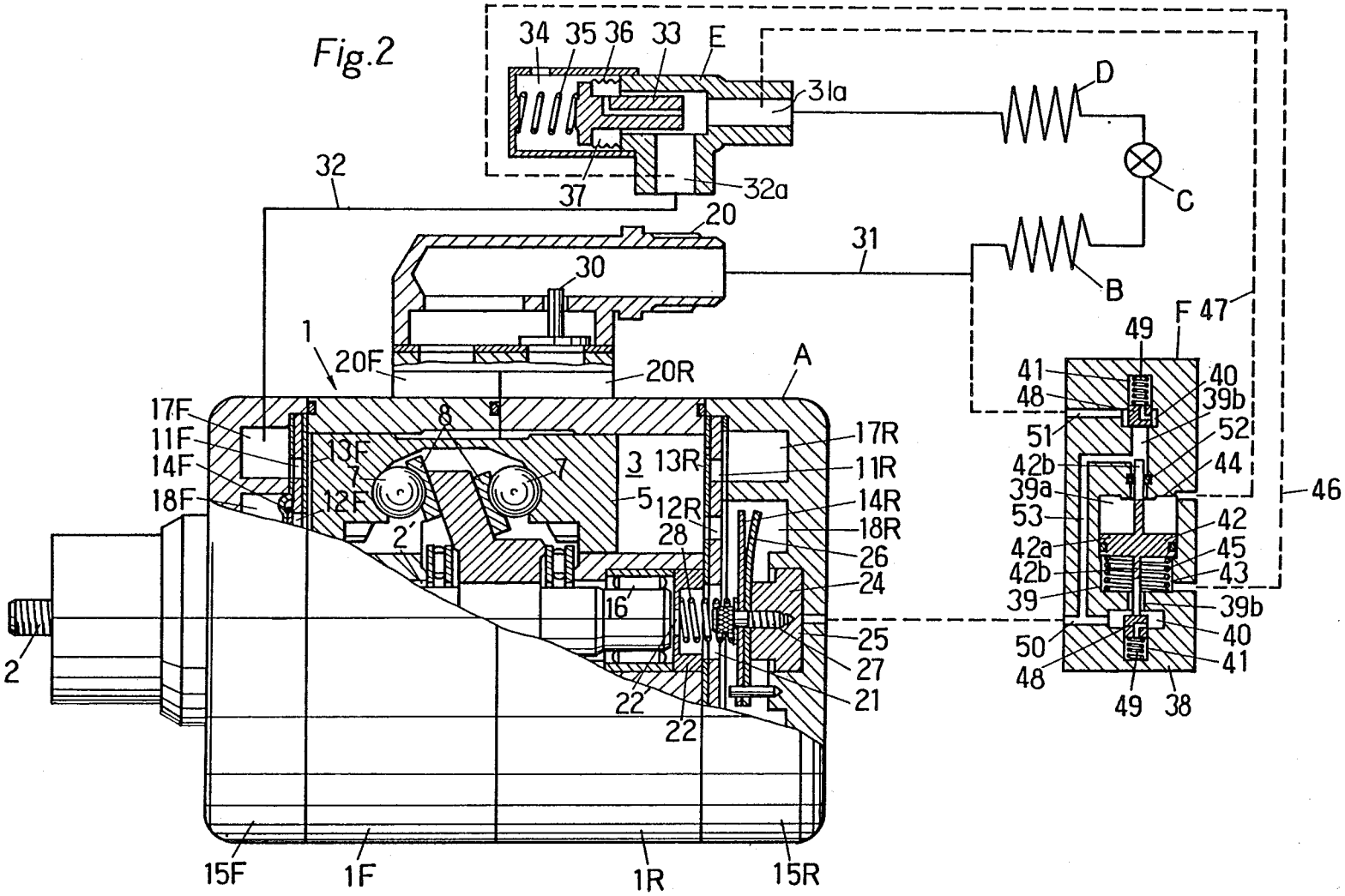
FIGS. 2 and 3 are cross-sectional views showing two different phases of operation of the compressor.
Figure 3:
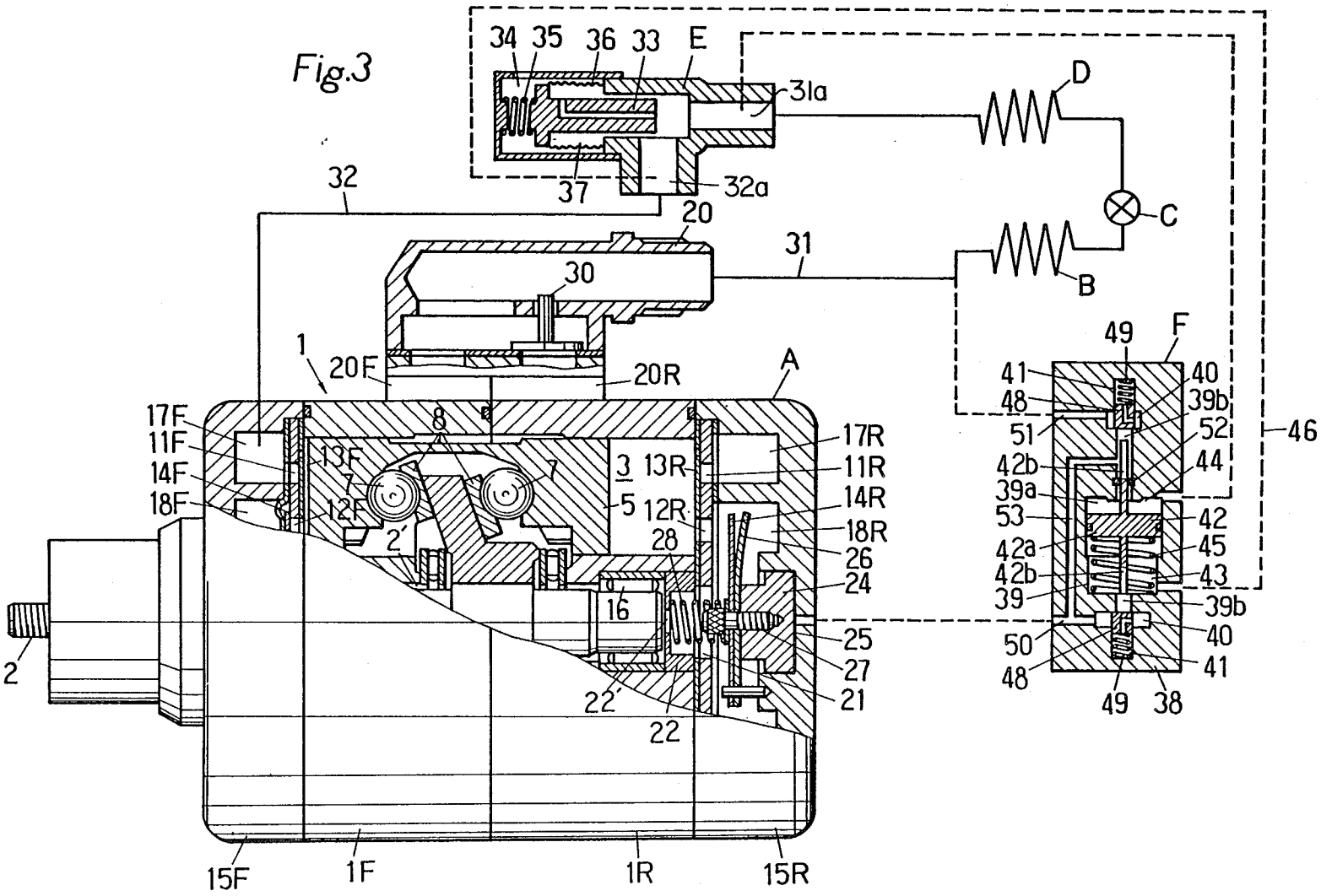

Referring to FIGS. 1 through 3, there is shown a compressor A of a well known double-acting swash plate type arranged in an air conditioning or refrigerating system having a condenser B connected to the discharge side of the compressor, an expansion valve C, and an evaporator D connected to the suction side of the compressor by way of a suction gas throttling valve E constituting part of the compressor. The compressor A further has a delivery control valve arrangement F.

The compressor A includes a cylinder block assembly generally designated by reference numeral 1 and having a front and rear cylinder blocks 1F and 1R sealingly connected in alignment with each other. A drive shaft 2 is received in the aligned central axial bores 2' formed in the cylinder blocks 1F, 1R and supported rotatably by radial bearings 16 pressed in the bores 2'. One end of the drive shaft 2 located adjacent to the front cylinder block 1F has an electromagnetic clutch (not shown) through which the drive power from an automotive engine (not shown) is transmitted to the drive shaft. The cylinder blocks 1F and 1R have therein formed a desired number of aligned paired cylinder bores 3, said pairs being equally angularly spaced around and in parallel to the drive shaft 2. As shown most clearly in FIG. 1, each pair of aligned cylinder bores 3 receives a double-headed piston 5 for reciprocal sliding movement therein, thus cooperating with the reciprocating piston 5 to form a working or compression chamber alternately on opposite sides of the cylinder bore 3. The drive shaft 2 carries a wobble or swash plate 6 in such a way that the latter can make a wobbling movement while being rotated by the drive shaft in a swash plate compartment or crankcase 4 defined by and between the front and rear cylinder blocks 1F and 1R. Each piston 5 is held to the outer inclined portion of the swash plate 6 by way of a pair of balls 7 and shoes 8 such that the wobbling motion of the plate may be converted into the above reciprocating movement of the piston 5.

The compressor A further comprises a front housing 15F sealingly bolted to the front cylinder block 1F with a front valve plate 10F interposed therebetween. Likewise, a rear housing 15R is clamped to the rear cylinder block 1R with a rear valve plate 10R interposed therebetween. In the front and rear housings 15F and 15R are formed substantially annular suction chambers 17F and 17R disposed in the outer peripheral portions of the respective housings, and discharge chambers 18F and 18R arranged in the central portions thereof and separated from the suction chambers by annular partitioning walls of the housings. The front and rear valve plates 10F, 10R are formed, respectively, with suction ports 11F and 11R through which refrigerant gas in the suction chambers 17F, 17R is admitted into the cylinder bore 3 and also with discharge ports 12F and 12R through which refrigerant gas compressed in the cylinder bores is forced out into the discharge chambers 18F, 18R. The suction ports 11F and 11R have suction valves 13F and 13R, respectively, which are arranged so as to be opened during alternate suction strokes of the double-acting piston 5 to thereby permit communication between each suction chamber 17F, 17R and its corresponding cylinder bore 3. The discharge ports 12F and 12R have discharge valves 14F and 14R, respectively, which are caused to open during alternate discharge strokes of the piston 5, thereby establishing communication between each discharge chamber 18F, 18R and its associated cylinder bore 3. As shown clearly in FIG. 2, the rear discharge valve 14R and a retainer 26 are secured by a clamp bolt 27 to a movable plunger 24 which is mounted centrally in the rear discharge chamber 18R, so that the discharge valve 14R carried by the plunger can move toward and away from the discharge port 12R in response to suction or discharge pressure which may be applied selectively to a pressure chamber 25 formed between the rear surface of the plunger 24 in any advanced position (FIG. 1) and the inner wall surface of the rear housing 15R. The selective application of the above pressures to the chamber 25 is accomplished by the delivery control valve arrangement F which is to be described in detail hereinafter. The rear valve plate 10R is formed at its center with a by-pass port 21 which may be closed by the discharge valve 14R, and at the center of the rear cylinder block 1R and adjacently to the valve there 21 is provided a spring holder 22 having a spring 28 mounted therein for urging the plunger 24 to retract to a position shown in FIG. 2 wherein the discharge valve 14R is located away from the discharge port 12R to thereby establish free communication between the compression chamber and the discharge chamber 18R independently of piston strokes. The spring holder 22 is formed at its seating base portion with a by-pass passage 22' which communicates with the crankcase 4 by way of its adjacent radial bearing 16 on the drive shaft 3. Though not shown very clearly in the drawings, it is to be understood that the compressor is so constructed that the crankcase 4 is in communication with the suction chambers 17F, 17R through suction passages in which through bolts (only one being shown at the bottom of the compressor shown in FIG. 1) are provided. In this way, when the plunger 24 is positioned where the rear discharge valve 14R is clear of its corresponding discharge port 12R, the refrigerant gas displaced by the piston is by-passed into the crankcase 4 through the by-pass port 21 in the valve plate 10R and by-pass passage 22' in the spring holder 22.

A suction flange (not shown) connected to suction gas line 32 and a discharge flange 20 connected to discharge gas line 31 are attached on the outer surface of the cylinder block assembly 1. Though the suction line 32 is shown schematically to be in direct connection with the suction chamber 17F, it is practically so arranged that the suction flange is in communication with the crankcase 4 which in turn communicates with the suction chambers 17F and 17R through the aforementioned suction passages. On the other hand, the discharge flange 20 communicates with the discharge chambers 18F and 18R by way of discharge passages 20F and 20R, respectively. A valve 30 is provided in the discharge flange 20 which is operable to open and close the discharge passage 20 depending on the mode of operation of the compressor A. The discharge line 31 connected to the outlet of the discharge flange 20 has the aforementioned condenser B, expansion valve C and evaporator D connected in this order. The evaporator outlet is connected to the notshown suction flange by way of the suction gas throttling valve E.

The throttling valve E includes a cylindrical valve body 33 mounted slidably in an axial stepped bore and having a bellows 36 cooperating with the valve body to form therebetween a pressure cell 37 receiving therein refrigerant gas under pressure and a spring 35 for urging the valve body in a direction which regulates or throttles the flow of refrigerant gas passing through the valve. A cap member is screwed so as to cover the spring 35 and the flanged head portion of the valve body 33 to thereby form a cell 34 which communicates with the atmospheric pressure through a vent port bored through the cap. Thus, the movable valve body 33 is positioned where the pressure in the cell 37 counterbalances with the combined force exerted by the atmospheric pressure and the spring tension.

Now referring to the compressor delivery control valve arrangement F, it comprises a valve housing 38 having formed therein a stepped, large bore 39 receiving therein a spool member 42 which is movable in response to the pressures applied to its opposite sides. The movable member has a central disc portion **42*a* slidably mounted in larger diametered bore portion 39*a* and two integral rod portions 42*b* extending in opposite directions. Two aligned small bores 39*b* are formed on opposite sides of the large bore 39 for receiving and guiding the rod portions 39*b*, respectively. Each bore 39*b* has a diameter which is large enough to form an annular space between its internal surface and the rod portion 42*b*. A port 40 is provided at the outer end of each small bore 39*b* for receiving therein a valve 48 actuable to open and close by the rod portions 42*b* moving together with the pressure responsive disc portion 42*a*. A closed bore 41 is formed on the outer side of each port 40 for guiding the movement of its corresponding valve 48 and receiving therein a spring 49 mounted in such a way to urge the valve inwardly for closure, thereby shutting off the communication between the port 40 and small bore 39*b*. The rod portions 42*b* have such lengths that one valve 48** only may be open at a time and also that both valves may be closed, as will be described in later part hereof.

A variable volume space or pressure chamber 43 is defined below the disc portion **42*a* of the spool member 42 and another variable volume space or pressure chamber 44 is formed on the opposite side of the disc portion, shown clearly in FIG. 2, when it is moved down against the pressure of a spring 45 located in the chamber 43 for urging the spool member upwardly. The chamber 43 communicates by way of suction pressure line 46 with an aperture or passage 32*a* formed in the throttling valve E on its outlet side adjacent to the not-shown suction flange. The other chamber 44 above the disc portion 42*a* communicates by way of evaporator pressure line 47 with an aperture or passage 31*a* in the throttling valve E on its inlet side adjacent to the evaporator D. For the sake of convenience in the description of the present invention, the chamber 43 in which the spring 45 is mounted is referred to as "suction pressure chamber", and the chamber 44 as "evaporator pressure chamber". A passage 50 is formed in the valve housing 38 to establish communication between the port 40 adjacent to the suction pressure chamber 43 and the aforementioned pressure chamber 25 behind the movable plunger 24. Another similar passage 51 is formed for communication between the port 40 adjacent to the evaporator pressure chamber 44 and the discharge line 31. An O-ring 52 is inserted in the small bore 39*b* adjacently to the evaporator pressure chamber 44 to seal the rod portion 42*b*. An internal passage 53 is formed in the valve body 38 in such a way to establish communication between the passages 51 and 50, when the valve 48 adjacent to the evaporator pressure chamber 44 is open, through the above-said annular space formed over the rod portion 42*b* on the side adjacent to the passage 51**.

Figure 4:
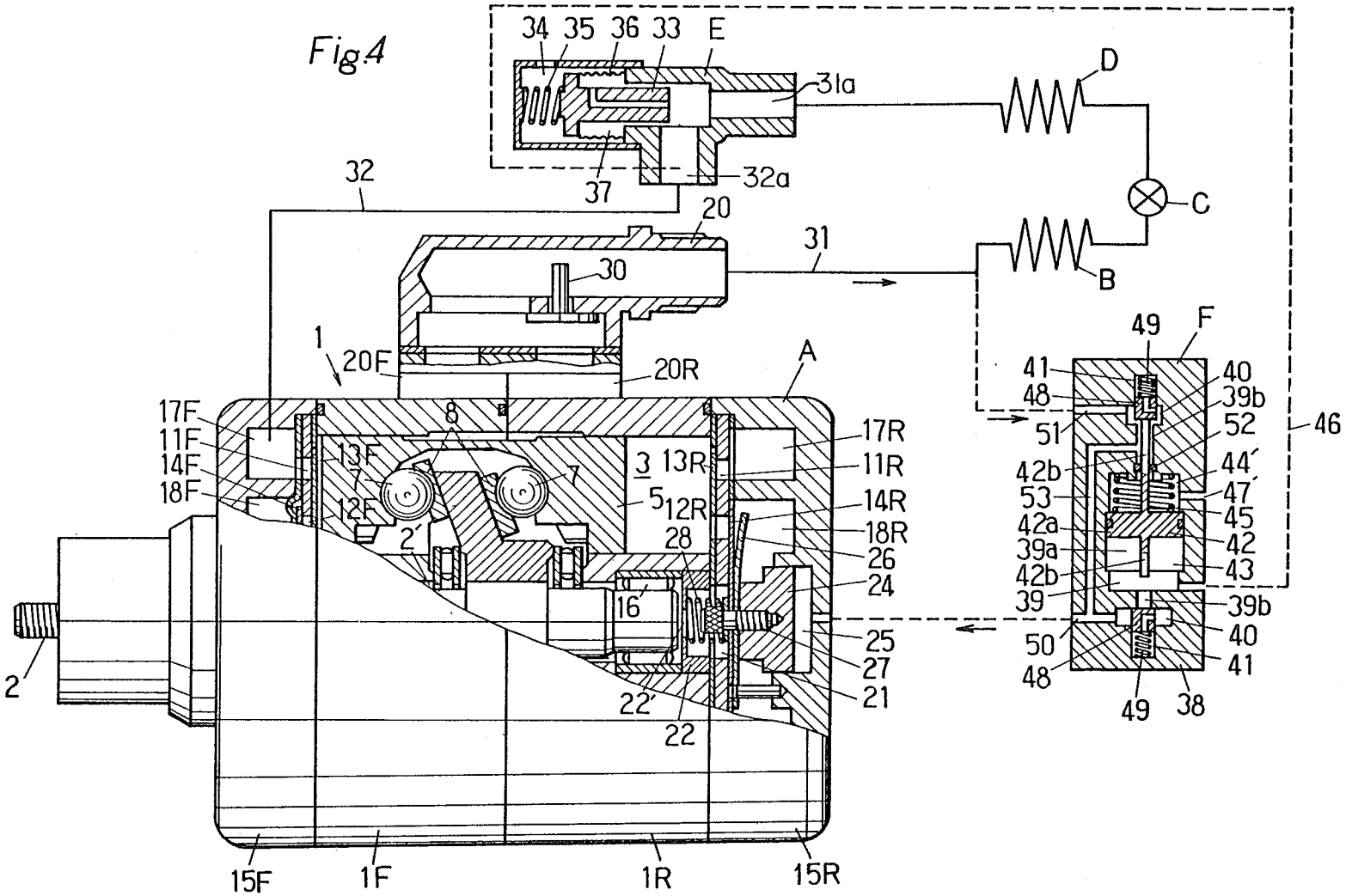
FIG. 4 is a cross-sectional view similar to that of FIG. 1, but showing another embodiment in accordance with the present invention.

Reference is now made to FIG. 4 which illustrates another embodiment in accordance with the present invention. The delivery control valve F of this second embodiment differs from the first embodiment in that the disc portion **42*a* of the spool member 42 is flanked by a chamber 43 communicating through the line 46 with the passage 32*a* in the throttling valve E and a chamber 44' which corresponds to the evaporator pressure chamber 44 but accommodates therein a spring 45 and vented to the atmosphere through a vent port 47'**. The construction of the compressor A and the throttling valve E is substantially the same as that of the first preferred embodiment.

Figure 5:
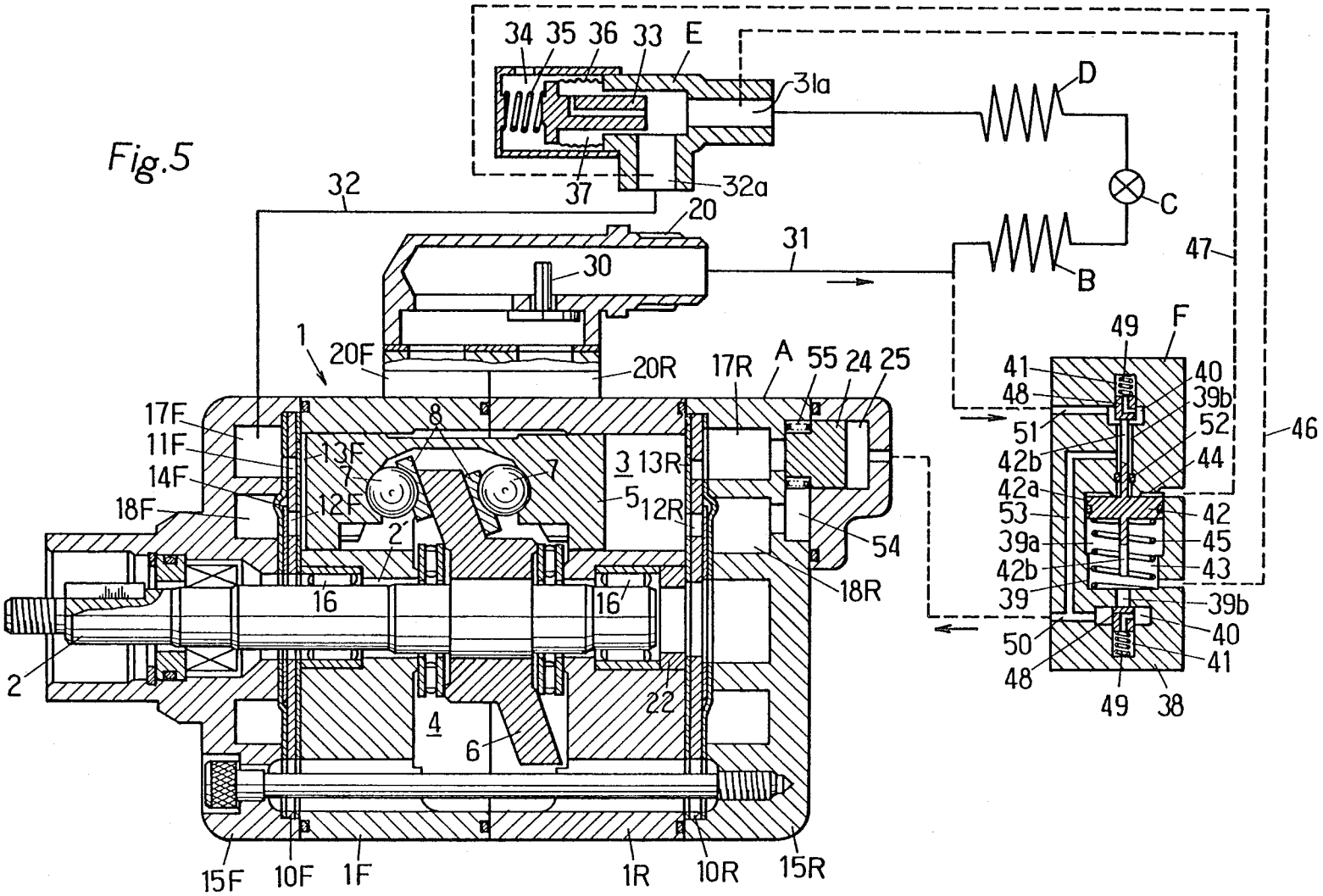
FIG. 5 is a cross-sectional view showing still another embodiment of the invention.

In still another embodiment shown in FIG. 5, the plunger 24 is mounted slidably behind the rear suction chamber 17R in such a way that its retraction causes the the car discharge chamber 18R to freely communicate with its adjacent rear suction chamber 17R through an aperture 54. The plunger 24, which is urged away from the rear suction chamber 17R by a spring 55, is movable toward said suction chamber under the influence of the pressure prevailing in the chamber 25 formed behind the plunger in communication with the passage 50 in the delivery control valve F.

Figure 7:
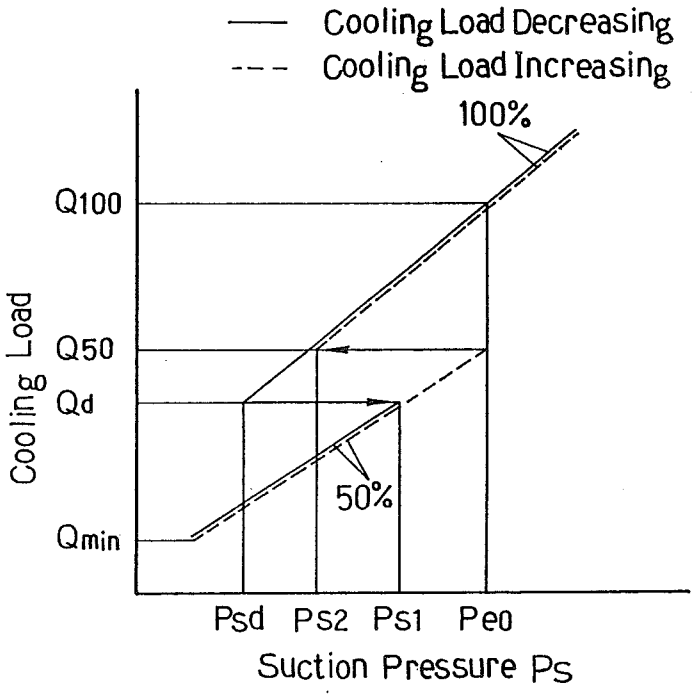
FIG. 7 is a diagram showing the relationship between the cooling load and the suction pressure.
Figure 6:
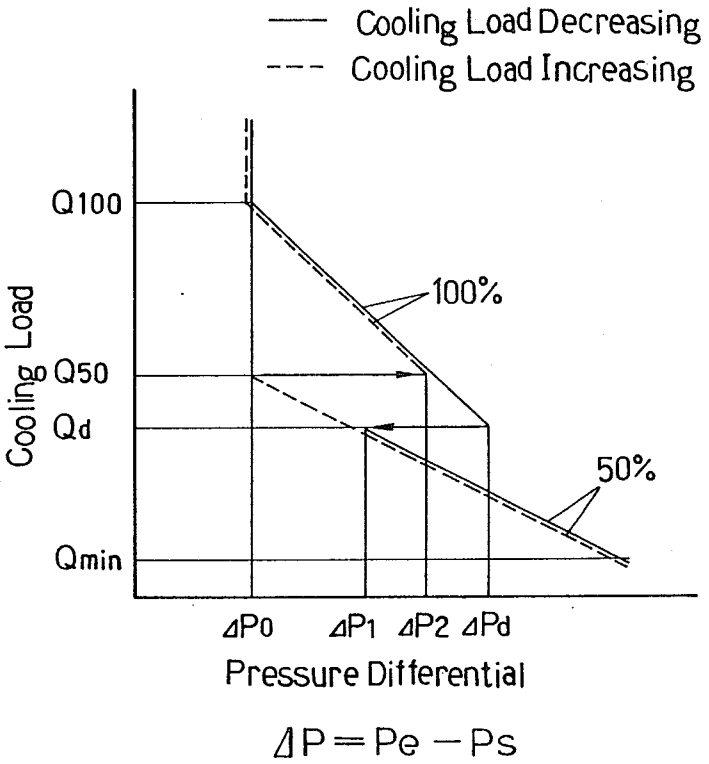
FIG. 6 is a diagram showing the relationship between the cooling demand or load and the evaporator-suction pressure differential.
Figure 9:
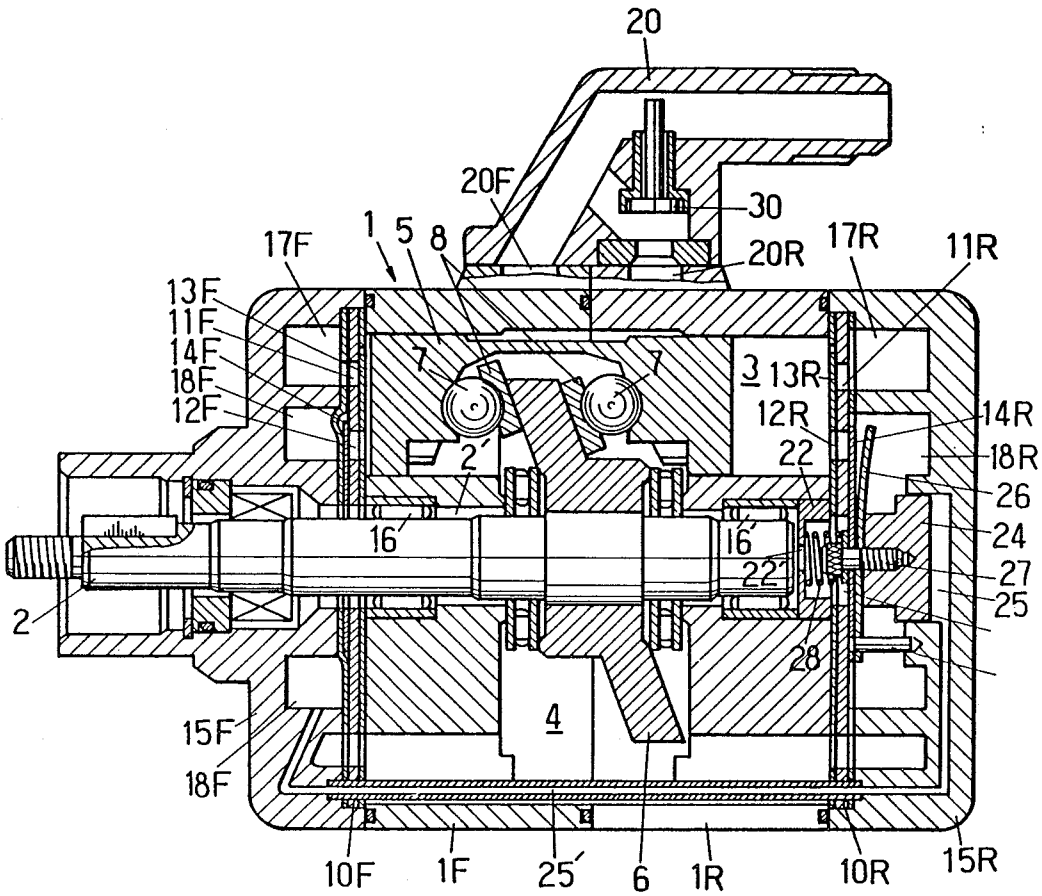
Fig. 9 (PRIOR ART)
FIGS. 9 and 10 are cross-sectional views illustrating conventional variable delivery refrigerant gas compressors of the double-acting swash plate type which have been used for description of the background of the invention.

The following will provide the detailed description of the operation of the compressor according to the present invention with specific reference to the first preferred embodiment illustrated in FIGS. 1 through 3 and with the diagrams shown in FIGS. 6 and 7.

When the temperature in the space to be cooled is high to such an extent that the cooling demand or load Q is greater than $Q_{100}$ (FIGS. 6 and 7), the pressure of the refrigerant gas issuing from the evaporator D is fairly high. Accordingly, the evaporator pressure $P_e$ then prevailing at the inlet of the throttling valve E and acting in the pressure cell 37 which is in direct communication with the evaporator outlet is elevated high enough to overcome the pressure acting in opposite direction, i.e., the combined force exerted by the spring 35 and the atmospheric pressure in the cell 34. Therefore, the valve body 33 is moved to a position shown in FIG. 1 where no throttling is effected by the throttling valve E, so that the suction pressure $P_s$ downstream of the throttling valve is of substantially the same level as the evaporator pressure $P_e$, i.e. the evaporator-suction pressure differential $\Delta P$ is substantially zero, as indicated by $\Delta P_0$ in FIG. 6. The evaporator pressure $P_e$ is transmitted through the line 47 to the evaporator pressure chamber 44 in the delivery control valve F, while the suction pressure $P_s$ is applied through the line 46 to the suction pressure chamber 43. Because the evaporator and suction pressures $P_e$ and $P_s$ are of substantially the same level, the movable spool member 42 is then positioned in its upper stroke end, as shown in FIG. 1, under the influence of the spring 45 provided in the chamber 43. Consequently, the valve 48 adjacent to the passage 51 is pushed open by its corresponding rod portion **42*b* against the pressure of the spring 49 to thereby establish communication between the passages 51 and 53 through the clearance passage between the rod portion 42*b* and small bore 39*b*, thus high pressure of the discharge gas in the discharge line 31 being transmitted to the chamber 25 through the passages 51 and 50 and applied to back side of the plunger 24. As a result, the plunger 24 is forced leftwards by application of the discharge pressure behind the plunger and pressed against the rear valve plate 10R while overcoming the combined force of the suction pressure in the crankcase 4 and the pressure exerted by the spring 28. In this way, the compressor A operates in its full or 100% delivery mode with the compression chambers on both front and rear sides of each double-acting piston 5** maintained under effective or "loaded" condition.

As the cooling load is reduced, as indicated by solid lines in FIGS. 6 and 7, further than $Q_{100}$ because of continued operation of the compressor A at such 100% delivery capacity, the evaporator pressure $P_e$ is decreased gradually. Accordingly, the pressure in the cell 37 is dropped and the valve body 33 in the throttling valve E is caused to move under the influence of the spring 35 in the direction to throttle the refrigerant gas passing therethrough. As a result of such throttling effect by which the flow of refrigerant gas passing through the valve E is regulated, a difference occurs between the evaporator and suction pressure $P_e$ and $P_s$. An increasing throttling effect due to continued reduction of the cooling load Q boosts up the evaporator-suction pressure differential $\Delta P$ and ultimately causes the spool member 42 of the control valve F to start moving downwards against the pressure of the spring 45. Such movement of the spool member 42 allows the upper valve 40 adjacent to the evaporator pressure chamber 44 to be closed, thereby shutting off the communication between the passages 51 and 53 with the lower valve 48 adjacent to the suction pressure chamber 43 maintained in its closed position. With both the upper and lower valves 48 thus held in their closed position, the discharge pressure is confined in the chamber 25 and, therefore, the rear compression chambers are kept under "loaded" condition. In this way, the compressor A continues to operate in its 100% delivery mode until the evaporator-suction pressure differential $\Delta P$ is increased to reach a predetermined control point $\Delta P_d$ corresponding to the cooling load $Q_d$.

When the evaporator-suction pressure differential $\Delta P$ reaches the control point $\Delta P_d$ with the cooling load reduced to $Q_d$ and the suction pressure to $P_{sd}$ (FIG. 7), respectively, the valve 48 adjacent to the suction pressure chamber 43 is pushed open by its associated rod portion **42*b* to thereby create communication between the suction line 46 and the chamber 25, as shown in FIG. 2. Then, the suction pressure obtainable after the throttling by the valve E is transmitted to the chamber 25 through the line 46, suction pressure chamber 43, small bore 39*b*, port 40 and passage 50. Because the pressure in the spring holder 33 cavity opposite the chamber 25 with respect to the plunger 24 is substantially at the suction pressure level due to its communication with the crankcase 4, the plunger is moved by the pressure of the spring 28 in the direction which causes the discharge valve 14R to move away from the rear valve plate 10R, thus opening the discharge port 12R. Because compression of the refrigerant gas in the rear cylinder bores 3 is thus rendered ineffective or placed under "unloaded" condition, the compressor A is operated then at its half or 50% delivery capacity. By so changing the mode of compressor operation from 100% to 50% delivery capacity at the cooling load $Q_d$, the suction pressure is increased from $P_{sd}$ to $P_{s1}$ (FIG. 7) and the pressure differential $\Delta P$ is decreased from $\Delta P_d$ to $P_1$ (FIG. 6). Such a decrease of the pressure differential causes the plunger member 42 of the control valve F to slide upwards by the pressure of the spring 45 to such an extent that the lower valve 48 adjacent to the suction pressure chamber 43 is brought to its closed position again, as shown in FIG. 3. In this position of the control valve F, the valves 48 are both in their closed position so as to retain suction pressure in the passages 50 and 53, thus maintaining the plunger 24** in a position for the 50% delivery mode of the compressor.

On the other hand, when the cooling load Q is increased, as indicated by dash lines in FIGS. 6 and 7, e.g. from the minimum level $Q_{min}$ during operation in 50% delivery mode, the pressure differential $\Delta P$ is decreased gradually until the cooling load reaches $Q_{50}$ where the pressure differential then becomes substantially zero, or $\Delta P_0$ at $Q_{50}$. Accordingly, the member 42 is moved upwards with the decreasing pressure differential $\Delta P$ under the influence of the spring 45 to ultimately push and open the valve 48 located adjacent to the evaporator pressure chamber 44, thereby establishing fluid communication between the line 31 and passage 50, as in the case shown in FIG. 1. Because the back side of the plunger 24 is then subjected to the discharge pressure, the plunger is positioned where the discharge port 12R is covered with the discharge valve 14R and, therefore, the compression chambers on the rear side are placed again under "loaded" condition for operation of the compressor in its 100% delivery mode. By so changing the compressor operation from 50% to 100% delivery capacity, the suction pressure is dropped from a level $P_{e0}$ (at which the suction pressure $P_s$ is substantially the same as the evaporator pressure $P_e$ and hence the pressure differential $\Delta P$ is zero) to $P_{s2}$ at the cooling load $Q_{50}$ and the pressure differential is increased from $\Delta P_0$ to $\Delta P_1$. Therefore, the spool member 42 is caused to slide toward the suction pressure chamber 43 to thereby allow the valve 48 adjacent passage 51 to be closed. Because the valves 48 are then both closed, the discharge valve 14R is kept pressed against the valve plate 10R by the discharge pressure then confined in the chamber 25. Thus, the compressor A operates in its 100% delivery mode with the compression chambers on both front and rear sides of each double-acting piston 5 maintained under "loaded" condition.

In the diagram of FIG. 6, "$Q_{100}$" is a point where the compressor can handle 100% cooling load and "$Q_{50}$" at $P_0$ represents a point where it can handle 50% cooling load, respectively.

Figure 8:
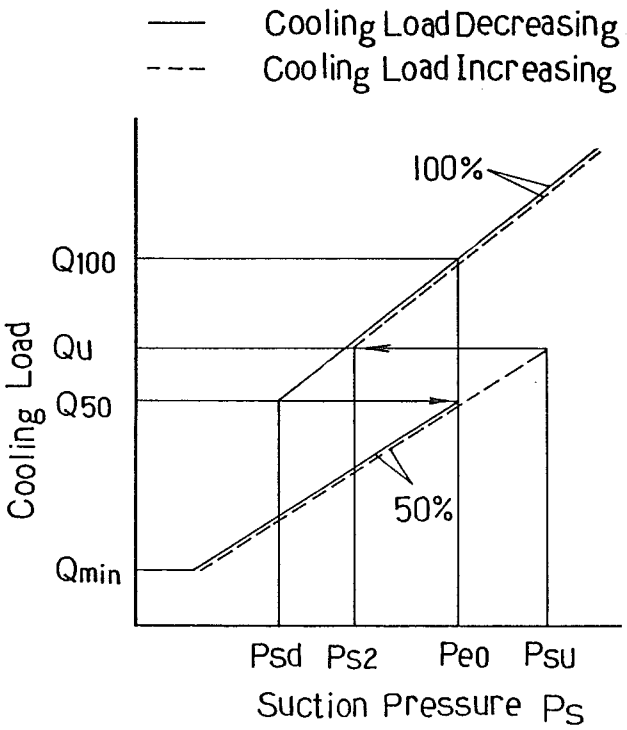
FIG. 8 is a diagrams showing the relationship between the cooling load and the suction pressure obtainable from the embodiment of FIG. 4.
Figure 10:
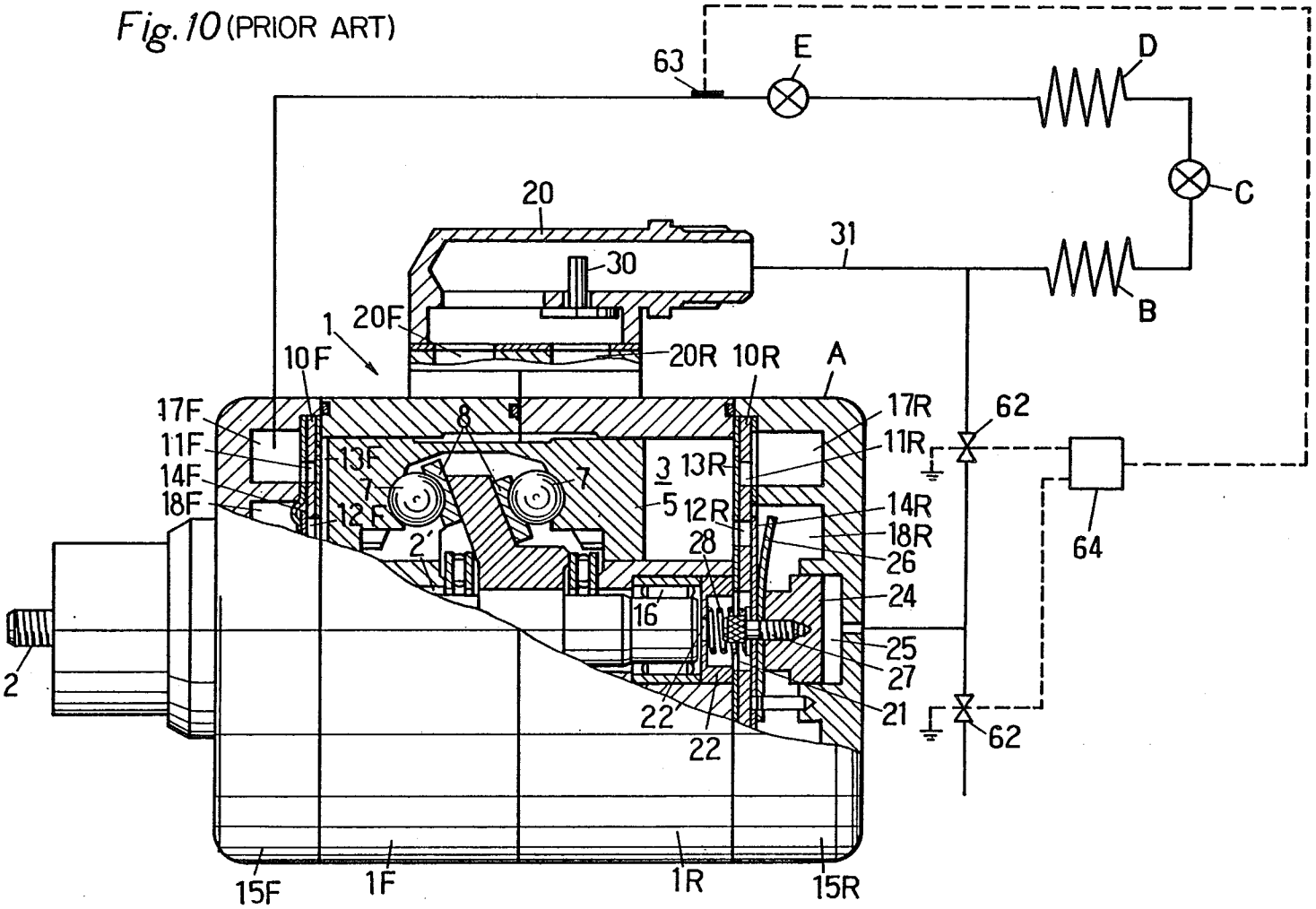
Fig. 10 (PRIOR ART)

In the embodiment of the delivery control valve F shown in FIG. 4, the spool member 42 can be actuated substantially in the same manner as in the embodiment of FIGS. 1 through 3 by the pressure differential between the atmospheric pressure prevailing in the chamber 44' and the suction pressure varying in the chamber 43, but the control points at which the compressor delivery capacity is changed from 100% to 50% and from 50% to 100% are shifted to $Q_{50}$ and $Q_u$ (which is higher than $Q_{50}$), respectively, as indicated in the diagram in FIG. 8.

While the invention has been described and illustrated specifically with reference to a desired embodiment, it is to be understood that the invention can be changed or modified without departing from the spirit or scope thereof.

What is claimed is:

1. A refrigerant gas compressor of the double-acting swash plate type connected in an air conditioning system including an evaporator connected to the suction side of said compressor, comprising;

a cylinder block having formed therein a crankcase, and at least one cylinder bore which receives therein a slidable doubleacting piston;

a swash plate driven mechanism in said crankcase and cylinder bore, said mechanism comprising a swash plate rotated by a drive shaft for producing reciprocal sliding movement of said piston, whereby respective compression chambers are formed alternately on opposite sides of said cylinder bore by the reciprocal movement of said piston;

a housing clamped to each end of said cylinder block with a valve plate interposed therebetween, each said housing having formed therein a suction chamber and a discharge chamber each of which chambers is communicable with an adjacent compression chamber through a suction port and a discharge port, respectively, formed through their said associated valve plate, the discharge chamber adjacent to one end of said cylinder block being communicable with the suction chamber adjacent thereto by passage means through said crankcase including a by-pass port formed through said valve plate;

means disposed in the connection line between the outlet of said evaporator and the suction side of said compressor for throttling the refrigerant gas passing therethrough in such a way that its throttling effect is increased with a decrease of evaporator pressure of refrigerant gas on the upstream side of said throttling means with respect to the flow of refrigerant gas so that the suction pressure prevailing on the downstream side of said throttling means is decreased relative to said evaporator pressure in response to an increase of the throttling effect of said throttling means;

a pressure responsive member disposed adjacent to the discharge chamber formed adjacent to said one end of the cylinder block and movable between a first position thereof wherein normal compression of refrigerant gas in said compression chamber is effected, and a second position thereof wherein refrigerant gas displaced by the piston is by-passed into said crankcase through said by-pass port whereby compression of refrigerant gas in said compression chamber is rendered ineffective, said compressor being thereby operable selectively substantially between its 100% delivery capacity when said pressure responsive member is in its said first position and its 50% delivery capacity when said pressure responsive member is in its said second position;

control means connected to said pressure responsive member for controlling its movement between its said first and second positions selectively in response to a varying of the pressure differential between the discharge pressure at said evaporator outlet and the suction pressure at said suction side of said compressor;

said control means including first valve means actuatable for establishing a communication passage of refrigerant gas under discharge pressure of the compressor for moving said pressure responsive member to said first position, second valve means actuatable for establishing a communication passage of refrigerant gas under said suction pressure of the compressor for moving said member to said second position, and means for selectively actuating said first and second valve means in response to a varying of the pressure differential between said evaporator discharge pressure and said compressor suction pressure.

2. A refrigerant gas compressor according to claim 1, wherein said actuating means is operable to act on said first valve means to establish said communication passage of refrigerant gas under said discharge pressure when said pressure differential is substantially zero, thereby moving said pressure responsive member to its said first position and maintaining said communication passage under said discharge pressure until said pressure differential is increased to a predetermined level.

3. A refrigerant gass compressor according to claim 1, wherein said control means includes a valve housing, and said actuating means includes a spool member movable within a fluid-tight space formed in said valve housing between positions toward and away from said first and second valve means in response to said varying pressure differential.

4. A refrigerant gas compressor according to claim 3, wherein said spool member is subjected to said evaporator discharge pressure on one side thereof adjacent to said first valve means and to said compressor suction pressure on the opposite side thereof adjacent to said second valve means.

5. A refrigerant gas compressor according to claim 4, wherein said spool member is moved toward said second valve means in response to an increase of said pressure differential and toward said first valve means in response to a decrease of said pressure differential, and said spool member has respective rod portions projecting from each side thereof for movement therewith and respectively actuatable on said first and second valve means to open the same for establishing said communication passage of refrigerant gas under said evaporator discharge and compressor suction pressures, respectively, one rod portion being operable to open said first valve means to establish said communication passage of refrigerant gas under said evaporator discharge pressure when said pressure differential is substantially zero, to thereby move said pressure responsive member to its said first position.

6. A refrigerant gas compressor according to claim 5, wherein said rod portions of the spool member have respective lengths whereby both of said first and second valve means are simultaneously maintained in their said closed positions while said compressor is operating substantially at its said 100% capacity.

* * * * *